US007310902B2

(12) United States Patent
Williams

(10) Patent No.: US 7,310,902 B2
(45) Date of Patent: Dec. 25, 2007

(54) PERSONAL SAFETY DEVICE

(76) Inventor: Janet Elizabeth Williams, 54 Tan-Y-Bryn, St. Asaph, Denbighshire, LL17 0PU (GB)

( * ) Notice: Subject to any disclaimer, the term of this patent is extended or adjusted under 35 U.S.C. 154(b) by 0 days.

(21) Appl. No.: 10/551,104

(22) PCT Filed: Dec. 31, 2003

(86) PCT No.: PCT/GB03/05717

§ 371 (c)(1),
(2), (4) Date: Dec. 9, 2005

(87) PCT Pub. No.: WO2004/086323

PCT Pub. Date: Oct. 7, 2004

(65) Prior Publication Data

US 2006/0117981 A1 Jun. 8, 2006

(30) Foreign Application Priority Data

Mar. 26, 2003 (GB) ..... 0306886.3

(51) Int. Cl.
*F41C 3/02* (2006.01)

(52) U.S. Cl. ..... 42/1.15; 102/504

(58) Field of Classification Search ..... 42/1.08, 42/1.15; 102/487, 504
See application file for complete search history.

(56) References Cited

U.S. PATENT DOCUMENTS

| | | | | |
|---|---|---|---|---|
| 2,965,029 | A * | 12/1960 | Jackson | 102/395 |
| 3,084,466 | A * | 4/1963 | Duncan, III | 42/1.08 |
| 3,361,066 | A * | 1/1968 | Gawlick et al. | 102/513 |
| 5,605,650 | A | 2/1997 | Cleary | |
| 5,629,678 | A * | 5/1997 | Gargano et al. | 340/573.4 |
| 5,652,570 | A | 7/1997 | Lepkofker | |
| 6,223,658 | B1 * | 5/2001 | Rosa et al. | 102/501 |

FOREIGN PATENT DOCUMENTS

| | | |
|---|---|---|
| FR | 1 269 166 | 8/1961 |
| JP | 8 124049 | 5/1996 |
| WO | 02/066678 A2 | 8/2002 |

OTHER PUBLICATIONS

Japanese Patent Abstracts, vol. 1996, No. 9; Sep. 30, 1996, 1 page.

* cited by examiner

*Primary Examiner*—Stephen M. Johnson
(74) *Attorney, Agent, or Firm*—Fulwider Patton LLP

(57) ABSTRACT

A personal safety device (10) includes at least one housing containing a quantity of a marking substance (30), an explosive charge (36), and a triggering apparatus (22) which is operative to detonate the explosive charge (36) to propel the marking substance from the housing (H) to mark the area surrounding the device.

17 Claims, 3 Drawing Sheets

PERSONAL SAFETY DEVICE

RELATED APPLICATIONS

This is a U.S. national phase of PCT/GB2003/005717 filed 31 Dec. 2003, claiming priority from GB 0306886.3 filed 26 Mar. 2003.

DESCRIPTION OF INVENTION

This invention relates to a personal safety device.

Personal safety devices are known which when actuated, spray an attacker with dye or a similar substance so that the attacker may later be identified. Such known devices, for example as exemplified in GB-A-1382833, use mechanical propellants to eject the dye, for example, are aerosol type arrangements.

However, a degree of forward planning and calm thinking is required for such devices to be properly employed, and these require some aiming to ensure that the attacker is marked with the dye.

Particularly children and elderly people, can lack the necessary dexterity properly to deploy the device, especially in a panic situation.

According to a first aspect of the invention we provide a personal safety device including at least one housing containing a quantity of a marking substance, an explosive charge, and a triggering apparatus which is operative to detonate the explosive charge to propel the marking substance from the housing to mark the area surrounding the device.

By providing for an explosive charge to propel the marking substance, the spread of the marking substance may be made to be very wide, making aiming of the device, as with known devices, unnecessary. Moreover, a triggering apparatus for detonating an explosive charge tends to be more easily operable than devices e.g. aerosol type arrangements, which require an operating button or the like to be depressed, and thus deployment of the device of the invention, in a panic situation, may be more reliable than with hithertofore known devices.

The triggering apparatus may be a mechanically actuated apparatus. For example the triggering apparatus may have an ignitor for igniting and thus detonating the explosive charge, the ignitor being actuated by moving one component relative to another component, to produce spark ignition by friction. One or both of the components may have chemically treated surfaces which react as the components are relatively moved, to enhance ignition.

In one embodiment, the housing may include a first housing part which in use is attached to the user or a structure, and a second relatively moveable housing part, movement of the second housing part relative to the first housing part actuating the triggering device. For example, where the triggering device includes a cord, for example attached to one or other of the triggering apparatus' relatively moveable components, the one component may be moved relative to the other by a user moving the second housing part away from the first housing part to pull on the cord.

In another arrangement, the device may include a first housing part mounted on a structure, such as a wall, for example in an old people's home. In the event of an attack, the device may be operated by removing a second housing part from the mounting of the first housing part, thus for example, to pull the cord and cause ignition and hence detonation of the explosive charge.

Desirably therefore in each case, the device is operable by one hand with minimum dexterity to achieve a successful deployment.

The device may include a guard which guards the device against accidental actuation. For example, where the housing includes first and second housing parts, the guard may include a slidable or otherwise moveable or removable part, which in normal use, prevents the housing parts being relatively moved and hence preventing the device being operated.

The guard is preferable readily moveable or removable in preparation for operation of the device, with minimal dextrous ability.

Because the user as well as an attacker for example will by virtue of the marking substance being propelled by an explosive charge, be marked with the substance, preferably the marking substance is a generally harmless substance. However, the marking substance may be a highly staining and difficult to remove dye so that an attacker cannot, at least readily, remove visible traces of the dye. Preferably the marking substance includes material which is not visible in the visual spectrum. For example the marking substance may include a fluorescent compound which is detectable under UV wavelength light; or a trace material detectable by chromatography, X-ray fluorescence, or other otherwise by spectroscopy;

Alternatively or additionally the marking substance may include a material with a unique identifier. In one example, such material may contain a unique chemical identifier such as DNA, or a chemically coded taggant.

In a preferred embodiment, the device includes a transmitter for transmitting a distress signal when the device is operated by actuating the triggering apparatus. In the event that the device is operated, such a signal may be used not only to provide an indication that the user is in distress, but to locate the user. User location may be achieved by triangulation of the transmitted signal, which may be a radio frequency signal, which may be detected by a radio receiver, a global positioning system or mobile telephone system where the signal is an appropriate digital signal.

If desired, the device may include a receiver to receive a signal from a remote location, the receiver being operable in response, to actuate the transmitter to transmit the distress signal. Thus where the user is a child for example who is lost, the transmitter may be actuated remotely, without actuating the triggering apparatus to release the marking substance, for the purposes of locating the lost child. Alternatively of course, where the user is injured or ill and is thus incapable of operating the device to actuate the transmitter, the user may be located by remote transmitter actuation.

It will be appreciated that unless such a receiver is provided, the device of the invention will only require power where a transmitter is provided, and when the device is operated. Thus the device will have a small power requirement only. Where a receiver is provided, the device will have a greater power requirement to power the receiver. Thus the device may include a re-chargeable or replaceable power pack.

According to a second aspect of the invention we provide a personal safety system including a personal safety device including at least one housing containing a transceiver, the transceiver being operable to transmit a distress signal, the system further including a remote receiver to receive the transmitted distress signal, and a remote transmitter for transmitting an actuating signal to the personal safety device, the transceiver receiving the remotely transmitted actuating signal and transmitting the distress signal in response.

The personal safety device may include any of the features of the personal safety device of the first aspect of the invention.

Desirably the system of the second aspect of the invention includes a plurality of remote receivers, so that the distress signal may be received by a receiver in range and used to locate the personal safety device.

Embodiments of the invention will now be described with reference to the accompanying drawings in which:—

Figure 1:
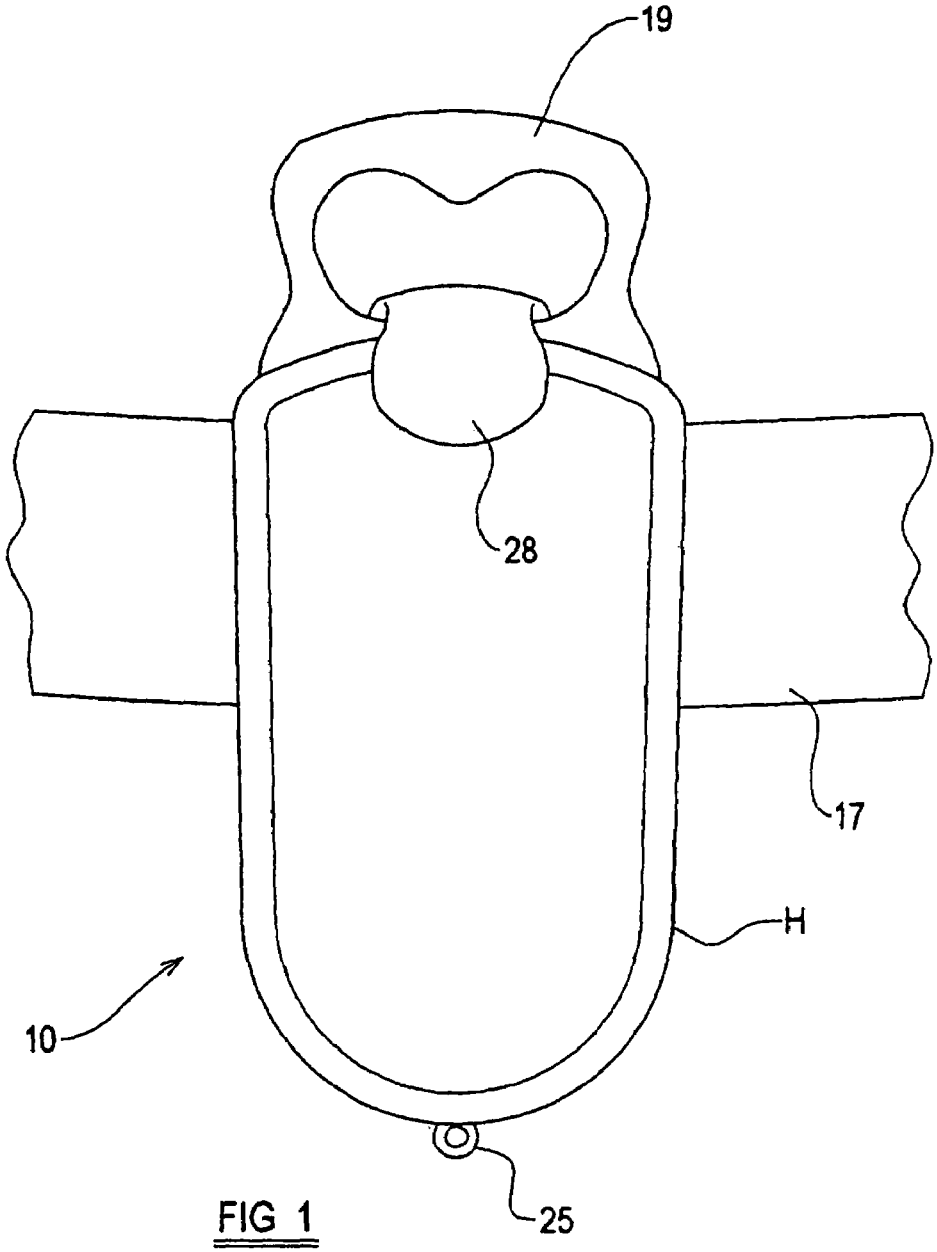
FIG. 1 is a perspective and purely illustrative front view of a personal safety device in accordance with the first aspect of the invention.

Referring to the drawings, a personal safety device 10 is shown which includes a housing H of first and second parts 11, 12.

The first housing part 11 includes a chamber 13 to receive a container 14 of the second housing part 12, and an integral mounting fitting being in this example a clip 16 for attaching the device 10 to an item of a user's clothing such as a belt 17.

The second housing part 12 includes a handle 19 attached to or integral with the container 14, to enable the second housing part 12 to be removed from the first housing part 11 as hereinafter described.

In a base 20 of the first housing part 11 there is an opening through which passes a cord 21 of a triggering apparatus 22 provided in the second container part 12, the cord 21 terminating in this example in a loop through which passes an actuating member 24. In this example the actuating member 24 is slidable in loops 25 of the first housing part 11, out of the loop of cord 21, to release the cord and so that movement of the second housing part 12 out of the first container part 11, for example for maintenance or inspection, does not actuate the triggering apparatus 22 as hereinafter described.

Figure 2:
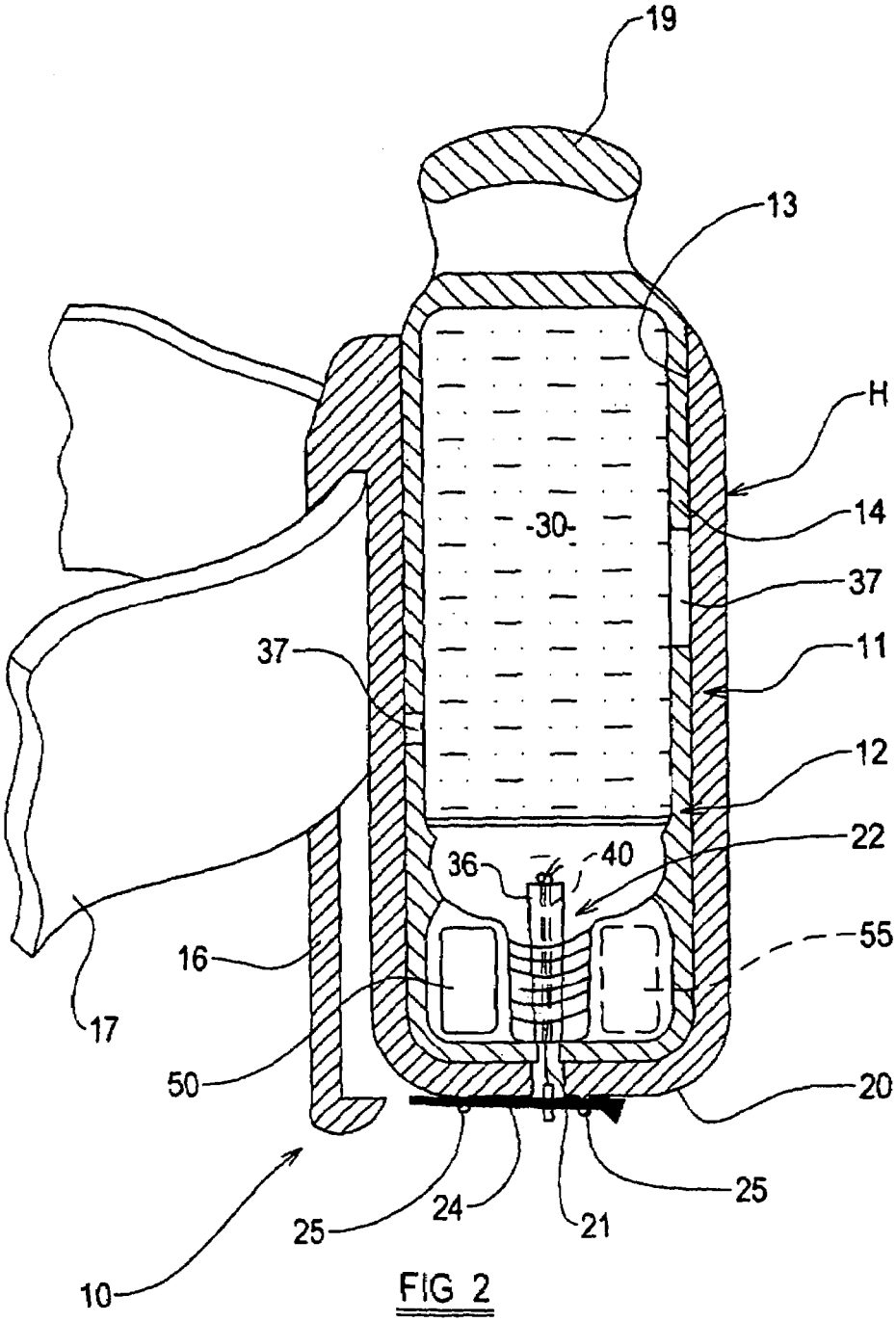
FIG. 2 is an illustrative side cross-sectional view of the device of FIG. 1.

In normal use though, the actuating member 24 is in the position shown in FIG. 2, and the triggering apparatus 22 is armed.

To prevent the inadvertent movement of the second housing part 12 relative to the first housing part 11 which could cause accidental operation of the device 10, there is provided a guard clip 28 (only shown in FIG. 1) which when in the position shown in FIG. 1 prevents the second housing part 12 being moved from the first housing part 11. However the guard clip 28 or an alternative guard, is readily removable to prepare the device 10 for use, without requiring any great manual dexterity. Thus the guard clip 28 may readily be removed by a user who is a small child or an elderly or infirm/handicapped individual user.

Within the container 14 of the second housing part 12, there is a quantity of a marking substance 30. The marking substance 14 may include one or more of the following materials.

First, the marking substance 30 may include a highly staining and difficult to remove dye so that an attacker marked with the substance upon operation of the device 10, cannot at least readily remove visible traces of the dye. Indelible skin staining dyes for such a purpose are well known and for use in the invention, preferably take the form of a powder, which when the device 10 is operated, will readily spread over and mark a large area.

Second the marking substance 30 includes material which is not visible in the visual spectrum. For example the marking substance 30 may include a fluorescent compound which is detectable under a UV wavelength light; or a trace material detectable by chromatography, X-ray fluorescence, or other otherwise by spectroscopy. Thus even upon an attacker removing all visible traces of the marking substance 30, the marking substance may be found upon forensic examination by the police for example.

Third, the marking substance 30 may include a material with a unique identifier. In one example, such material may contain a unique chemical identifier such as DNA, or a chemically coded taggant.

Chemically coded taggants are known for the purposes of identifying the source of a product, there being a near-infinite number of individual chemical codes available. Thus desirably, the marking substance 30 of each container 14 is unique to that container 14, so that upon such substance being found upon an alleged attacker, it can be proved that the marking substance originated from a particular device 10.

Examples of suitable chemicals for taggants are indicators from the group including benzyl acetate, anisyl acetate, geranyl acetate, a-methyl acetate, p-tolyl acetate, vanillan acetate, amyl acetate, 2-methyl butyl acetate, isomyl acetate, nonyl acetate, decyl acetate, heptyl acetate, octyl acetate, lauryl acetate and combinations thereof.

In each case the marking substance needs to be a generally harmless substance as not only the attacker, but the user and perhaps passers-by will be subjected to marking with the substance, operating a device 10 according to the invention.

In accordance with the invention, when the device 10 is operated, an explosive charge 36 is detonated, to propel the marking substance 30 out of one or any one of a plurality of openings 37 in the container 14. The explosive charge 36 may be a pyrotechnic or fireworks type charge, which is detonated by ignition, the size of the charge 36 being carefully chosen to be the minimum required to propel the marking substance 30 over a wide area, to ensure that an attacker is marked without requiring the user carefully to aim the device 10.

In this example, the charge 36 is ignited by the triggering apparatus 22 upon removal of the inner second housing part 12 from the first housing part 11. The cord 21 carries, or is, a first component of an ignitor, and may be treated with a first chemical. The cord 21 is received in a sheath 40 which is fixed in the triggering apparatus 22 and is a second component of the ignitor, the arrangement being such that when the cord 21 is pulled so as to move the first component relative to the sheath 40, a spark occurs, enhanced by the chemical treatment of at least one of the two components i.e. the cord 21 and its sheath 40, the spark igniting the explosive charge 36.

The cord 21 is of a length that ignition does not occur until the second housing part 12 has been moved sufficiently out of the first housing part 11 to unveil the opening or openings 37 through which the marking substance 30 is propelled.

The device 10 further includes a transmitter 50, located in the second housing part 12 in this example, although may alternatively be provided in the first housing part 11.

The triggering apparatus 22 when actuated, includes a switch which actuated, causes the transmitter 50 to transmit a distress signal. Desirably the distress or alarm signal is wholly silent, but may include an audible noise if required. The transmitted distress signal may be received by one or more receivers 52 (see FIG. 3) of a personal safety system. The received signal may simply indicate that the device 10 has been operated, or by triangulation, may be used to locate the device 10, and hopefully the user.

The transmitted signal may be a simple RF signal, and desirably the personal safety system includes a plurality of receivers 52 so that at least one of the receivers 52 will be in range of the transmitted alarm signal. In this case, such receivers 52 may be positioned at strategic points, such as at police stations. The RF signal may be of a unique frequency or character, so that the actual device 10 transmitting the signal may be identified.

Alternatively the transmitted signal may be a suitable digital signal which may be received by global positioning satellites or by a mobile telephone digital network. Again the digital signal may contain information to enable the identity of the device 10 emitting the transmitted distress signal to be identified.

In FIG. 2 it can be seen that a battery power pack 55 is also provided in the second housing part 11 to power the transmitter 50 when the device 10 is operated. The device 10 as described so far, has no power requirement until the device 10 is operated and the distress signal is transmitted. Thus the battery 55 may be of small capacity and therefore light in weight.

Access to the battery 55 to change the battery 55 may be obtained by removing the actuating member 24 from the loop of cord 21, and then separating the housing parts 11, 12. However, if desired, the battery 55 may be re-chargeable via a socket connection, without having to separate the housing parts 11, 12.

Figure 3:
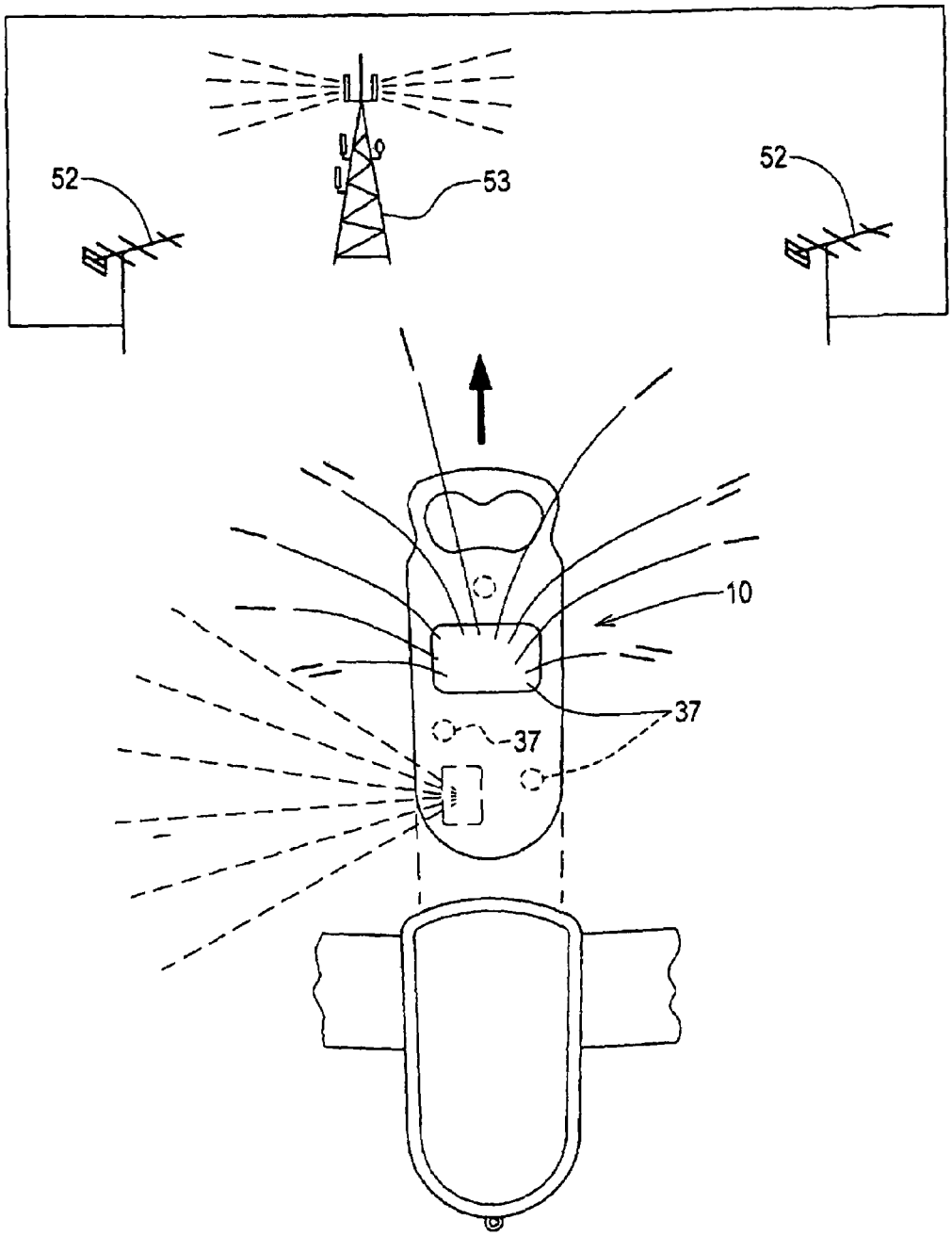
FIG. 3 is an illustrative view of a personal safety system in accordance with the second aspect of the invention.

In another embodiment, the device 10 includes a transceiver 50 having both a transmitter and a receiver functionality. The receiver is able to receive an externally and remotely generated signal unique to the device 10, e.g. from a remote transmitter 53 as indicated in FIG. 3. Such a signal will not actuate the triggering apparatus 22 of the device 10, but is operable to switch on the internal transmitter 50 to transmit the distress signal. Because the remotely transmitted signal is unique to the device 10, other similar devices in the area will not be actuated.

In this event a larger battery 55 may be required as the receiver function of the transceiver 55 will require power continuously to enable the receiver to be ready to receive an appropriately remotely transmitted signal, and/or the battery 55 will require frequent re-charging or changing to maintain the transceiver 55 in a ready state.

Various modifications may be made without departing from the scope of the invention.

For example, although described as a device 10 for wearing on the person, the device 10 may be adapted to be mounted on a structure such as a wall of a building e.g. of an old peoples' home, or an elderly person's home, possibly adjacent an entrance, so that the device 10 may be operated in a panic/emergency situation by removing a second housing part 12 from a wall or other structure-mounted first housing part 11.

In another example, the housing H may not include first and second housing parts 11, 12, but a single housing part may have an external trigger of a triggering apparatus by virtue of which, when actuated, the device 10 is operated to cause explosive charge 36 to detonate to propel the marking substance 30 from the housing.

A triggering apparatus which does not require the explosive charge 36 to be ignited may be provided, for example a triggering apparatus in which chemicals are mixed upon device operation to detonate an explosive charge to propel the marking substance 30 from the device 10.

The shape and configuration of the device 10 shown in the drawings is purely exemplary and many modifications may be made.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A personal safety system including a personal safety device including at least one housing containing a quantity of a marking substance that includes a unique chemical identifier that contains synthetic DNA, a propellant, a triggering apparatus including an initiator which is operative to activate the propellant to propel the marking substance from the housing to mark the area surrounding the device, and transceiver operable to transmit an RF distress signal that is of a unique frequency or character, so that the actual device transmitting the signal may be identified, the system further including a remote receiver to receive the transmitted distress signal, and a remote transmitter for transmitting an actuating signal to the personal safety device, the transceiver receiving the remotely transmitted actuating signal and transmitting the distress signal in response.

2. A system according to claim 1 wherein the system includes a plurality of remote receivers, so that the distress signal is receivable by a receiver in range and used to locate the personal safety device.

3. A personal safety device including at least one housing containing a quantity of a marking substance, an explosive charge, and a triggering apparatus including an ignitor which is operative to detonate the explosive charge to propel the marking substance from the housing to mark the area surrounding the device wherein the ignitor is actuated by moving one component relative to another component, to produce spark ignition by friction; wherein the housing includes a first housing part and a second relatively moveable housing part, movement of the second housing part relative to the first housing part to operate the triggering device; and wherein the triggering device includes a cord attached to one or other of the triggering apparatus'relatively moveable components, the one component being moved relative to the other by a user moving the second housing part away from the first housing part to pull on the cord.

4. A device according to claim 3 wherein one or both of the components has a chemically treated surface which reacts as the components are relatively moved, to enhance ignition.

5. A device according to claim 3 wherein the first housing part is attached in use, to a user or a structure.

6. A device according to claim 3 wherein the device includes a guard which conceals or otherwise guards the triggering apparatus against accidental actuation.

7. A device according to claim 6 wherein the housing includes a first housing part and a second relatively moveable part, movement of the second housing part relative to the first housing part operating the triggering device, and wherein the guard includes a slidable or otherwise moveable or removable part, which in normal use, prevents the housing parts being relatively moved and hence preventing the triggering apparatus being actuated.

8. A device according to claim 6 wherein the guard is readily moveable or removable in preparation for operation of the device, with minimal dextrous ability.

9. A device according to claim 3 wherein the marking substance is a generally harmless substance.

10. A device according to claim 3 wherein the marking substance includes a highly staining and difficult to remove dye.

11. A device according to claim 3 wherein the marking substance includes material which is not visible in the visual spectrum.

12. A device according to claim 11 wherein the marking substance includes a fluorescent compound which is detectable under UV wavelength light; or a trace material detectable by chromatography, X-ray fluorescence, or other otherwise by spectroscopy.

13. A device according to claim 3 wherein the marking substance includes a material with a unique identifier.

14. A device according to claim 13 wherein said unique identifier is a unique chemical identifier selected from the group consisting of DNA and a chemically coded taggant.

15. A device according to claim 3 wherein the device includes a transmitter for transmitting a distress signal when the device is operated by actuating the triggering apparatus.

16. A device according to claim 15 wherein the device includes a receiver to receive a signal from a remote location, the receiver being operable in response, to actuate the transmitter to transmit the distress signal.

17. A personal safety device including at least one housing containing a quantity of a marking substance that includes a unique chemical identifier that contains synthetic DNA, a propellant, a triggering apparatus including an initiator which is operative to activate the propellant to propel the marking substance from the housing to mark the area surrounding the device, and transmitter operable to transmit an RF distress signal that is of a unique frequency or character, so that the actual device transmitting the signal may be identified.

* * * * *